US005496672A

United States Patent [19]

Akimoto et al.

[11] Patent Number: 5,496,672

[45] Date of Patent: Mar. 5, 1996

[54] COATING SOLUTION FOR CHARGE GENERATION LAYER AND ELECTROPHOTOGRAPHIC PHOTORECEPTOR USING SAME

[75] Inventors: Takayuki Akimoto; Shigeru Hayashida; Megumi Matsui; Mikio Itagaki, all of Ibaraki, Japan

[73] Assignee: Hitachi Chemical Co., Ltd., Tokyo, Japan

[21] Appl. No.: 240,358

[22] Filed: May 10, 1994

[30] Foreign Application Priority Data

Jun. 11, 1993 [JP] Japan ..... 5-140808

[51] Int. Cl.[6] ..... G03G 5/04; G03G 5/06

[52] U.S. Cl. ..... 430/78; 430/96

[58] Field of Search ..... 430/78, 96

[56] References Cited

U.S. PATENT DOCUMENTS

| | | | |
|---|---|---|---|
| 3,682,631 | 8/1972 | Honjo | 430/96 X |
| 5,096,793 | 3/1992 | Ozawa et al. | 430/59 X |
| 5,312,705 | 5/1994 | Tsuchiya et al. | 430/58 |

FOREIGN PATENT DOCUMENTS

| | | | |
|---|---|---|---|
| 142726 | 6/1989 | Japan | 430/96 |
| 239562 | 9/1989 | Japan | 430/96 |

*Primary Examiner*—Roland Martin

*Attorney, Agent, or Firm*—Antonelli, Terry, Stout & Kraus

[57] ABSTRACT

Disclosed are a coating solution for forming a charge generation layer, which comprises:

(A) a phthalocyanine composition, (B) a binder resin represented by the formula:

(I)

wherein R represents an alkylene group, $R^1$ represents an alkyl group; and m, n and k each represent a ratio of recurring unit numbers and are numerals satisfying the relations of $k+m+n=1$, $n>m>0$ and $0.3 \geqq k \geqq 0$, (C) at least one of a melamine resin and a benzoguanamine resin in a 1- to 5-fold amount in terms of the weight ratio of the amount of the binder resin, and (D) a solvent having both a hydroxyl group and an ether group in one molecule, and an electrophotographic photoreceptor using the same.

22 Claims, 2 Drawing Sheets

COATING SOLUTION FOR CHARGE GENERATION LAYER AND ELECTROPHOTOGRAPHIC PHOTORECEPTOR USING SAME

BACKGROUND OF THE INVENTION

This invention relates to a coating solution for forming a charge generation layer and an electrophotographic photoreceptor using the same.

In the prior art, in an electrophotographic photoreceptor in which a photoconductive substance is used as a photosensitive material, inorganic photoconductive substances such as selenium, zinc oxide, titanium oxide and cadmium oxide have been mainly used. However, many of these substances have strong toxicity so that they have also problems in disposal methods.

On the other hand, in general, when organic photoconductive compounds are used, toxicity is weaker and there are advantages in the points of transparency, flexibility, lightweight property, surface smoothness and price as compared with the case of using inorganic photoconductive substances. Therefore, electrophotographic photoreceptors using organic photoconductive compounds have been studied widely. When these photoreceptors are applied to an electrophotographic device according to the Carlson method, an image can be obtained by forming an electrostatic image on the surface of the photoreceptor, developing the photoreceptor by a developer, the so-called toner, charged to the same charge (+ or −) as or a different charge from that of the electrostatic image, and then transferring and fixing a toner image onto a different substrate such as paper.

In recent years, there have been reported many photoreceptors using an organic photoconductive compound and having sensitivity to around 800 nm which is the wavelength of a diode laser region. However, in many of these, a phthalocyanine pigment is used as a charge generation substance, and a photosensitive layer is formed by using a coating solution obtained by dispersing the pigment in a binder resin.

In phthalocyanines which are pigments, not only absorption spectrum and photoconductivity vary depending on central metals, but also these physical properties vary depending on crystal forms. There have been reported several examples of phthalocyanines in which the same central metal is used, but a specific crystal form is selected for an electrophotographic photoreceptor.

For example, there has been reported that various crystal forms exist in titanylphthalocyanines, and charging characteristics, dark decay and sensitivity vary greatly depending on the difference of their crystal forms.

In Japanese Provisional Patent Publication No. 49544/1984, it has been described that a crystal form of titanylphthalocyanine giving strong diffraction peaks at 9.2°, 13.1°, 20.7°, 26.2° and 27.1° of Bragg angles (2θ±0.2°) is preferred, and an X-ray diffraction spectrum chart is shown.

Also, in Japanese Provisional Patent Publication No. 166959/1984, there has been shown a charge generation layer obtained by allowing a vapor deposited film of titanylphthalocyanine to stand in tetrahydrofuran-saturated vapor for 1 to 24 hours to change a crystal form. It has been shown that the X-ray diffraction spectrum shows a smaller number of wide peaks and gives strong diffraction peaks at 7.5°, 12.6°, 13.0°, 25.4°, 26.2° and 28.6° of Bragg angles (2θ).

Further, in Japanese Provisional Patent Publication No. 17066/1989, there has been described that a crystal form of titanylphthalocyanine having main peaks at least at 9.5°, 9.7°, 11.7°, 15.0°, 23.5°, 24.1° and 27.3° of Bragg angles (2θ±0.2°) is preferred.

In Japanese Provisional Patent Publications No. 131243/1990 and No. 214867/1990, there has been described that a crystal form of titanylphthalocyanine having a main diffraction peak at 27.3° of Bragg angles is preferred.

As described above, titanylphthalocyanine exhibits extremely high sensitivity and excellent characteristics by changing a crystal form. However, in a laser printer for which it is used, higher quality and higher precision have been achieved, and an electrophotographic photoreceptor having further high sensitivity characteristic has been demanded.

As a binder resin, there have been used a polyester resin, a polyvinyl chloride resin, a silicone resin, a polystyrene resin, a polyvinyl butyral resin and a phenoxy resin.

In Japanese Provisional Patent Publication No. 183263/1990, there has been shown titanylphthalocyanine with which a polyester resin as a binder resin and 1,2-dichloroethane as a dispersion solvent are used.

In Japanese Provisional Patent Publication No. 231753/1991, there has been shown X type non-metal phthalocyanine with which a modified polyvinyl chloride resin as a binder resin and tetrahydrofuran as a dispersion solvent are used.

In Japanese Provisional Patent Publication No. 10257/1991, there has been shown titanylphthalocyanine with which a polyhydroxystyrene resin as a binder resin and ethanol as a dispersion solvent are used.

In Japanese Provisional Patent Publication No. 33863/1991, there has been shown titanylphthalocyanine with which an acryl resin as a binder resin and cyclohexanone as a dispersion solvent are used.

In Japanese Provisional Patent Publication No. 33863/1991, there has been shown titanylphthalocyanine with which a phenol resin as a binder resin and methyl isobutyl ketone as a dispersion solvent are used.

In Japanese Provisional Patent Publication No. 81861/1992, there has been shown titanylphthalocyanine with which a polyvinyl butyral resin as a binder resin and 1,2-di-methoxyethane as a dispersion solvent are used.

However, in either case, electrophotographic characteristics such as charging characteristics, dark decay and sensitivity are not necessarily satisfactory, and a halogen type solvent having problems in dispersion stability, coating property, electrophotographic characteristics and environmental sanitation is required to be used as a dispersion solvent.

SUMMARY OF THE INVENTION

An object of the present invention is to provide a coating solution for forming a charge generation layer in which the above problems in the prior art can be solved, electrophotographic characteristics such as charging characteristics, dark decay and sensitivity are excellent, and dispersion stability and coating property are good, and an electrophotographic photoreceptor using the same.

The present invention relates to a coating solution for forming a charge generation layer, which comprises:

(A) a phthalocyanine composition, (B) a binder resin represented by the formula (I):

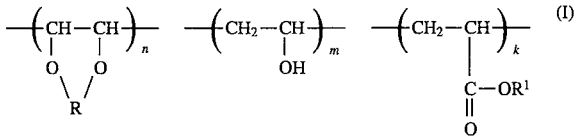

(I)

wherein R represents an alkylene group, $R^1$ represents an alkyl group; and m, n and k each represent a ratio of recurring unit numbers and are numerals satisfying the relations of k+m+n=1, n>m>0 and $0.3 \geqq k \geqq 0$, (C) at least one of a melamine resin and a benzoguanamine resin in an amount of 1- to 5-fold in terms of the weight ratio based on the amount of the binder resin, and (D) a solvent having both a hydroxyl group and an ether group in one molecule, and an electrophotographic photoreceptor using the same.

DESCRIPTION OF THE PREFERRED EMBODIMENTS

Figure 1:
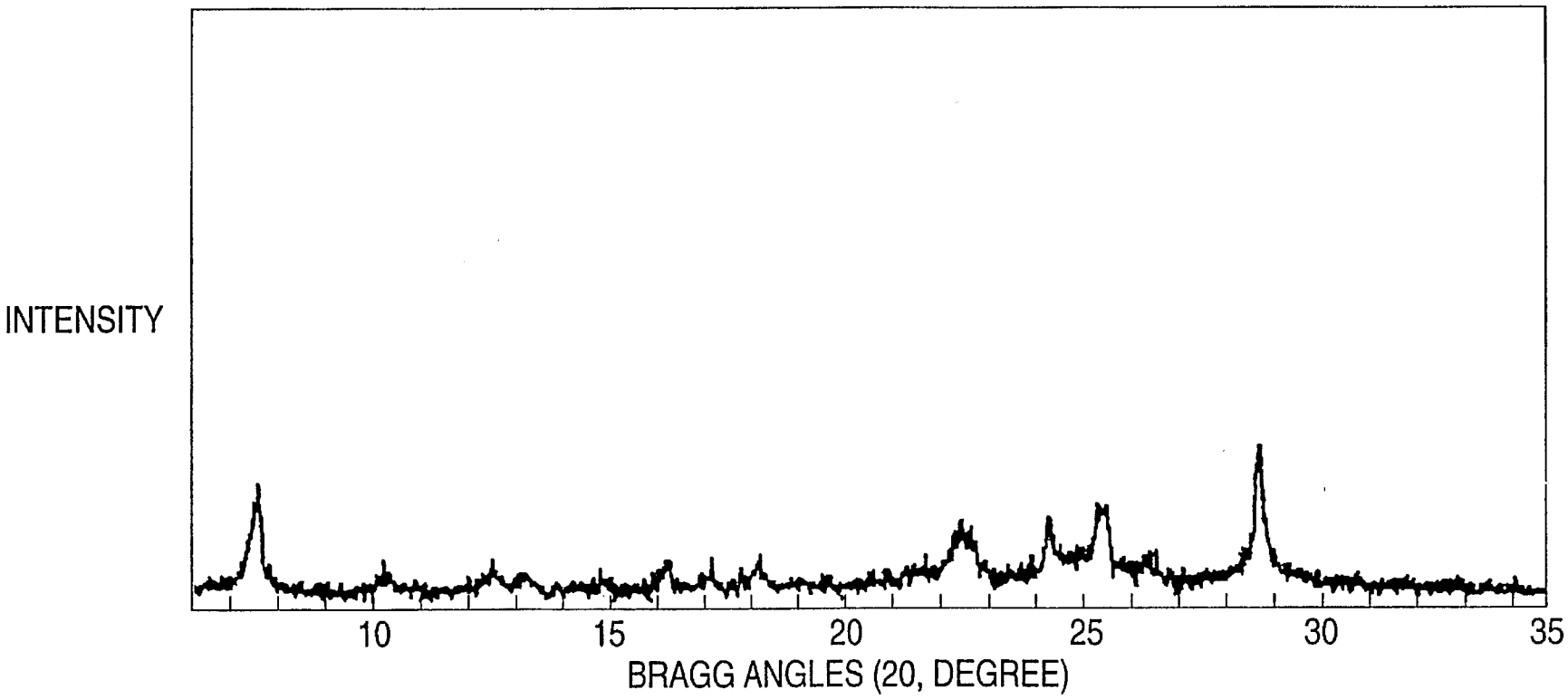
FIG. 1 is an X-ray diffraction spectrum of a phthalocyanine composition prepared in Preparation example 1.

In the following, the present invention is described in detail.

The phthalocyanine composition (A) of the present invention is not particularly limited, and known phthalocyanine compositions may be used. However, the phthalocyanine composition (A) containing titanylphthalocyanine is preferred from the point of electrophotographic characteristics. Further, the phthalocyanine composition (A) obtained by making amorphous a phthalocyanine mixture of titanylphthalocyanine and a halogenated metal phthalocyanine in which a central metal is trivalent and then treating the resulting amorphous mixture with an organic solvent is preferred from the point of electrophotographic characteristics, and it is more preferred that the above trivalent metal is indium (In). Further, it is preferred from the point of electrophotographic characteristics that the phthalocyanine composition (A) has main diffraction peaks at 7.5°, 22.5°, 24.3°, 25.3° and 28.6° of Bragg angles (2θ±0.2°) in an X-ray diffraction spectrum with Cu Kα.

The titanylphthalocyanine described above can be obtained by referring to, for example, the description of Japanese Provisional Patent Publication No. 71144/1991, and can be prepared, for example, as mentioned below.

To 120 ml of α-chloronaphthalene is added 18.4 g (0.144 mole) of phthalonitrile, and then 4 ml (0.0364 mole) of titanium tetrachloride is added dropwise to the mixture under nitrogen atmosphere. After the dropwise addition, the mixture is heated and reacted at 200° to 220° C. for 3 hours under stirring, and then the reaction mixture is filtered while heating at 100° to 130° C. and the residue is washed with α-chloronaphthalene and then with methanol. The residue is hydrolyzed (90° C., 1 hour) with 140 ml of a deionized water, and this operation is repeated until the solution becomes neutral. The residue is then washed with methanol. Subsequently, the residue was sufficiently washed with N-methylpyrrolidone heated to 100° C. and then washed with methanol. The compound thus obtained is dried by heating at 60° C. under vacuum to obtain titanylphthalocyanine (yield: 46%).

In the above halogenated metal phthalocyanine compounds in which a central metal is trivalent, a trivalent metal as a central metal includes In, Ga and Al, preferably In, and a halogen includes Cl and Br. Said compounds may have a substituent(s) such as a halogen on a phthalocyanine ring. These compounds are known compounds, and among them, for example, a synthetic method of monohalogen metal phthalocyanine and monohalogen metal halogen phthalocyanine is described in Inorganic Chemistry, 19, 3131 (1980) and Japanese Provisional Patent Publication No. 44054/1984.

The monohalogen metal phthalocyanine can be prepared by, for example, the following manner.

To 100 ml of quinoline distilled twice and deoxidized are added 78.2 mmole of phthalonitrile and 15.8 mmole of metal trihalide, and the mixture is refluxed under heating for 0.5 to 3 hours. After gradually cooled, the mixture is cooled to 0° C. and then filtered. The crystal is washed with methanol, toluene and then acetone, and dried at 110° C.

Further, the monohalogen metal halogen phthalocyanine can be prepared by the following manner. After 156 mmole of phthalonitrile and 37.5 mmole of metal trihalide are mixed and melted at 300° C., the mixture is heated for 0.5 to 3 hours to obtain a composition of monohalogen metal halogen phthalocyanine. The composition is washed with α-chloronaphthalene by using a Soxhlet extractor.

In the present invention, as to a composition ratio of the phthalocyanine mixture containing titanylphthalocyanine and a halogenated metal phthalocyanine in which a central metal is trivalent, the content of the titanylphthalocyanine is preferably in the range of 20 to 95% by weight, more preferably in the range of 50 to 90% by weight, particularly preferably in the range of 65 to 90% by weight, most preferably in the range of 75 to 90% by weight from the point of electrophotographic characteristics such as charging characteristics, dark decay and sensitivity.

The phthalocyanine mixture can be made amorphous by the acid pasting method.

For example, 1 g of the phthalocyanine mixture is dissolved in 50 ml of conc. sulfuric acid, and the solution is added dropwise to 1 liter of a deionized water cooled with ice water to be reprecipitated. After filtration, the precipitates are washed with pure water and then with a mixed solution of methanol/pure water until a washing solution has a pH of 2 to 5, and then dried at 60° C. to obtain powder of a phthalocyanine composition. The X-ray diffraction spectrum of the powder thus obtained becomes a spectrum having no clear sharp peak and showing wide amorphous state. As a method of making it amorphous, in addition to the above acid pasting method using conc. sulfuric acid, there is also a method by dry milling.

By treating powder of the phthalocyanine mixture which is thus made amorphous with an organic solvent to change a crystal form, a phthalocyanine composition having main diffraction peaks at 7.5°, 22.5°, 24.3°, 25.3° and 28.6° of Bragg angles (2θ±0.2°) in an X-ray diffraction spectrum with Cu Kα can be obtained.

For example, 1 g of powder of the phthalocyanine mixture which is made amorphous by the above method is added to 10 ml of N-methyl-2-pyrrolidone, toluene or xylene as an organic solvent, and the mixture is heated while stirring (the above powder/organic solvent (in terms of the weight ratio) is 1/1 to 1/100).

The heating temperature is 50° C. to 200° C., preferably 80° C. to 150° C., and the heating time is 1 hour to 10 hours, preferably 1 hour to 8 hours. After completion of the heating while stirring, the mixture is filtered, and the residue is washed with methanol and dried by heating at 60° C. under vacuum to obtain 700 mg of crystal of the phthalocyanine composition of the present invention. As the organic solvent to be used in this treatment, there may be mentioned, for example, alcohols such as methanol, ethanol, isopropanol and butanol, alicyclic hydrocarbons such as n-hexane, octane and cyclohexane, aromatic hydrocarbons such as benzene, toluene and xylene, ethers such as tetrahydrofuran, dioxane, diethyl ether, ethylene glycol dimethyl ether, 2-methoxyethanol and ethylene glycol diethyl ether, ketones such as 2-ethoxyethyl acetate (Cellosolve acetate, trade name), acetone, methyl ethyl ketone, cyclohexanone, isophorone and 1,3-dimethyl-2-imidazolidinone, esters such as methyl acetate and ethyl acetate, non-chlorine type organic solvents such as dimethyl sulfoxide, dimethylformamide, phenol, cresol, anisole, nitrobenzene, acetophenone, benzyl alcohol, pyridine, N-methyl-2-pyrrolidone, quinoline, tetralin and picoline, and chlorine type organic solvents such as dichloromethane, dichloroethane, trichloroethane, tetrachloroethane, carbon tetrachloride, chloroform, chloromethyloxirane, chlorobenzene and dichlorobenzene.

Among these, ketones and non-chlorine type organic solvents are preferred, and among them, N-methyl-2-pyrrolidone, 1,3-dimethyl-2-imidazolidinone, pyridine, methyl ethyl ketone and diethyl ketone are preferred.

The electrophotographic photoreceptor of the present invention has a charge generation layer containing a charge generation substance and a charge transport layer containing a charge transport substance, provided on a conductive substrate.

The coating solution for forming a charge generation layer of the present invention contains the phthalocyanine composition (A), the binder resin (B) represented by the formula (I), at least one of the melamine resin and benzoguanamine resin (C) in a 1- to 5-fold amount (weight ratio) of the amount of the binder resin (B) and the solvent (D) having both a hydroxyl group and an ether group in one molecule, as essential components.

The binder resin (B) represented by the formula (I) is a resin which has been already known, and as a commercially available product, there may be mentioned, for example, a polyvinyl acetal resin Ethlec KS-5Z (trade name, produced by Sekisui Kagaku Kogyo Co.) and polyvinyl butyral resins Ethlec BMS (trade name, produced by Sekisui Kagaku Kogyo Co.) and Denka Butyral #5000-A (trade name, produced by Denki Kagaku Kogyo Co.).

In the formula (I), R is an alkylene group preferably having 1 to 4 carbon atoms, more preferably 1 or 2 carbon atoms, more specifically, there may be mentioned a methylene group, an ethylene group, a propylene group, an isopropylene group, a butylene group, etc. $R^1$ is a straight or branched alkyl group preferably having 1 to 12 carbon atoms, more preferably 1 to 6 carbon atoms, more specifically, there may be mentioned a methyl group, an ethyl group, a butyl group, an isobutyl group, a sec-butyl group, a tert-butyl group, a hexyl group, a 2-ethylhexyl group, an octyl group, a decyl group, a dodecyl group, an undecyl group, etc.

In the formula (I), in the case of $k>0.3$, dispersibility of the coating solution for forming a charge generation layer is worsened, and in the case of $m \geqq n$, humidity resistance of the electrophotographic photoreceptor and dispersibility of the coating solution for forming a charge generation layer are worsened. The polymerization degree of the binder resin (B) represented by the formula (I) is preferably in the range of 300 to 3,000. If it is less than 300, mechanical strength of the photoconductive layer tends to be poor and also tends to be corroded by a coating solvent of a charge transport layer which is coated for preparing a composite type electrophotographic photoreceptor, while if it exceeds 3,000, operatability or working property during preparation of the photoconductive layer tends to be worsened.

The coating solution for forming a charge generation layer of the present invention contains at least one of the melamine resin and benzoguanamine resin (C) as an essential component(s). As the melamine resin or benzoguanamine resin, there have been generally known those obtained by treating an amino group bonded to a triazine ring with formaldehyde to be converted into methylol and modifying methylol with an alcohol. The melamine resin is commercially available, for example, as Melan 289 (trade name, produced by Hitachi Chemical Co., Ltd.) and the benzoguanamine resin is commercially available, for example, as Melan 331 (trade name, produced by Hitachi Chemical Co., Ltd.). The melamine resin or benzoguanamine resin forms a photoconductive layer having excellent film formation property, dispersibility, adhesion property and humidity resistance and has effects of improving sensitivity, responsibility to light, potential-maintaining property, residual potential and image characteristics. It is particularly preferred that 50% or more of amino groups bonded to triazine rings are converted into methylols and 50% or more of said methylols are modified. As an alcohol to be used for modification, propyl alcohol, n-butanol and isobutanol are preferred.

The melamine resin and benzoguanamine resin (C) are used in total in a 1- to 5-fold amount (weight ratio) of the amount of the binder resin (B) represented by the formula (I) . The amount to be used is preferably a 1.01- to 5-fold amount, more preferably a 1.3- to 3-fold amount, particularly preferably a 1.5- to 2.5-fold amount. If the amount to be used is too small, water absorption is increased, whereby bad influences such as blurring of an image and lowering of potential-maintaining property and sensitivity are brought about when said resin is used for an electrophotograph. On the other hand, if the amount to be used is too large, water absorption is increased, whereby film properties of a charge generation layer become hard and fragile to lower mechanical characteristics.

As the solvent (D) having both a hydroxyl group and an ether group in one molecule of the present invention, there may be mentioned, for example, 2-methoxyethanol, 2-ethoxyethanol, 2-propoxyethanol, 2-butoxyethanol, 2-hexyloxyethanol, tetrahydrofurfuryl alcohol, 1-methoxy-2-propanol, 1-ethoxy-2-propanol and 1-propoxy-2-propanol. Among them, 1-methoxy-2-propanol is preferred from the points of dispersibility, dispersion stability (e.g. the phthalocyanine composition (A) is hardly precipitated), coating property and environmental sanitation.

A solvent (E) other than the above solvent (D) having both a hydroxyl group and an ether group in one molecule may be used, but it is preferred that the solvent (D) having both a hydroxyl group and an ether group in one molecule is contained in the range of 20 to 100% by weight based on the total amount of the solvents. If the amount of the solvent (D) is less than 20% by weight, film quality of the photoconductive layer is easily worsened, whereby bad influences are easily exerted on almost all electrophotographic characteristics such as sensitivity, potential-maintaining property, residual potential and image quality.

Further, when the evaporation rate of the solvent (E) other than the solvent (D) having both a hydroxyl group and an ether group in one molecule is defined as v2 and that of the solvent (D) having both a hydroxyl group and an ether group in one molecule is defined as v1, it is preferred to select the solvent (D) and the solvent (E) so as to have a relationship of v1<v2. Here, the evaporation rate is a value measured at 25° C. under a pressure of 1013 hectopascal (760 mmHg). In the case of v1≧v2, it may be difficult to obtain a desired film thickness, a phenomenon of poor uniformity of a film thickness may be observed or unevenness of image density may be caused.

In the coating solution for forming a charge generation layer, it is preferred that the phthalocyanine composition (A) and, if necessary, an organic pigment generating a charge to be used are contained, and that the total amount of the binder resin (B) and the melamine resin and/or benzoguanamine resin (C) is controlled to an amount in the range of 5 to 500% by weight, more preferably 20 to 300% by weight, based on the total amount of the phthalocyanine composition (A) and the above organic pigment (charge generation substance). The coating solution for forming a charge transport layer contains a charge transport substance, and the amount of a binder for a charge transport layer is preferably controlled to an amount of 500% by weight or less based on the amount of the charge transport substance. If the charge transport substance is a compound having a low molecular weight, a binder is preferably contained in an amount of 50% by weight or more based on the amount of the charge transport substance.

As the organic pigment generating a charge mentioned above, there may be mentioned, for example, an azo pigment and a squaraine pigment.

As the above charge transport substance, there may be mentioned a compound having a high molecular weight such as poly-N-vinylcarbazole, halogenated poly-N-vinylcarbazole, polyvinyl pyrene, polyvinyl indoloquinoxaline, polyvinyl benzothiophene, polyvinyl anthracene, polyvinyl acridine and polyvinyl pyrazoline, and the compound having a low molecular weight such as fluorenone, fluorene, 2,7-dinitro-9-fluorenone, 4H-indeno(1,2,6)thiophen-4-one, 3,7-dinitrodibenzothiophene-5-oxide, 1-bromopyrene, 2-phenylpyrene, carbazole, N-ethylcarbazole, 3-phenylcarbazole, 3-(N-methyl-N-phenylhydrazone)methyl-9-ethylcarbazole, 2-phenylindole, 2-phenylnaphthalene, oxadiazole, 2,5-bis(4-diethylaminophenyl)-1,3,4-oxadiazole, 1-phenyl-3-(4-diethylaminostyryl)-5-(4-diethylaminostyryl)-5-(4-diethylaminophenyl)pyrazoline, 1-phenyl-3-(p-diethylaminophenyl)pyrazoline, p-(dimethylamino)-stilbene, 2-(4-dipropylaminophenyl)-4-(4-dimethylaminophenyl)-5-(2-chlorophenyl)-1,3-oxazole, 2-(4-dimethylaminophenyl)-4-(4-dimethylaminophenyl)-5-(2-fluorophenyl)-1,3-oxazole, 2-(4-diethylaminophenyl)-4-(4-dimethylaminophenyl)-5-(2-fluorophenyl)-1,3-oxazole, 2-(4-dipropylaminophenyl)-4-(4-dimethylaminophenyl)-5-(2-fluorophenyl)-1,3-oxazole, imidazole, chrysene, tetraphene, acridene, triphenylamine, benzidine and derivatives thereof. As the charge transport substance, the benzidine derivative represented by the following formula (II) is particularly preferred.

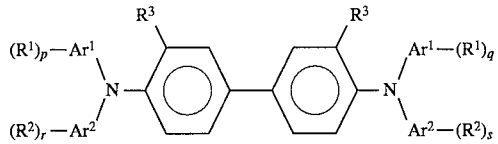

(II)

wherein $R^1$ and $R^2$ each independently represent a hydrogen atom, a halogen atom, an alkyl group, an alkoxy group, an aryl group, a fluoroalkyl group or a fluoroalkoxy group, two $R^3$s each independently represents a hydrogen atom or an alkyl group, $Ar^1$ and $Ar^2$ each independently represents an aryl group, and p, q, r and s each represent an integer of 1 to 5.

In the formula (II), the alkyl group may include those having 1 to 4 carbon atoms such as a methyl group, an ethyl group, an n-propyl group, an iso-propyl group, an n-butyl group and a tert-butyl group. The alkoxy group may include those having 1 to 3 carbon atoms such as a methoxy group, an ethoxy group, an n-propoxy group and an iso-propoxy group. The aryl group may include a phenyl group, a tolyl group, a biphenyl group, a terphenyl group and a naphthyl group. The fluoroalkyl group may include those having 1 to 3 carbon atoms such as a trifluoromethyl group, a trifluoroethyl group and a heptafluoropropyl group. The fluoroalkoxy group may include those having 1 to 4 carbon atoms such as a trifluoromethoxy group, a 2,3-difluoroethoxy group, a 2,2,2-trifluoroethoxy group, a 1H,1H-pentafluoropropoxy group, a hexafluoro-isopropoxy group, a 1H,1H-pentafluorobutoxy group, a 2,2,3,4,4,4-hexafluorobutoxy group and a 4,4,4-trifluorobutoxy group. Specific examples of the compound represented by the formula (II) may include Compounds No. 1 to No. 6 shown below.

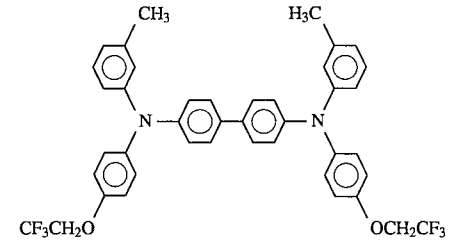

No. 1

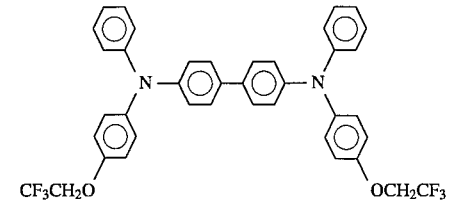

No. 2

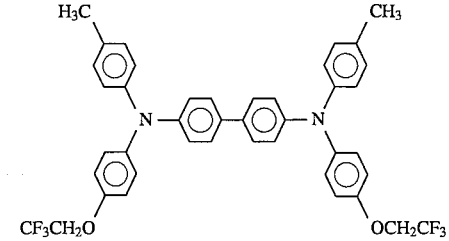

No. 3

-continued

No. 4

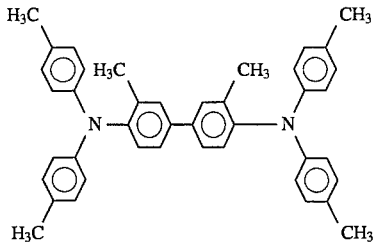

No. 5

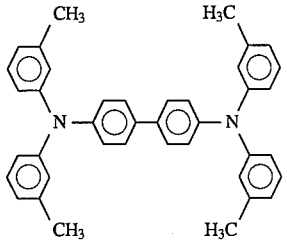

No. 6

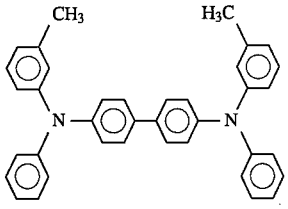

As the binder for a charge transport layer which can be used in the above charge transport layer, there may be mentioned a silicone resin, a polyamide resin, a polyurethane resin, a polyester resin, an epoxy resin, a polyketone resin, a polycarbonate resin, a polyacrylic resin, a polystyrene resin, a styrene-butadiene copolymer, a poly(methyl methacrylate) resin, a polyvinyl chloride, an ethylene-vinyl acetate copolymer, a vinyl chloride-vinyl acetate copolymer, a polyacrylamide resin, a polyvinylcarbazole, a polyvinyl pyrazoline and a polyvinyl pyrene. Further, a thermosetting resin and a photocuring resin which are crosslinked by heat and/or light may be also used. In either case, the binder is not particularly limited so long as it is a resin which has insulation property and can form a film under normal conditions, and a resin which is cured by heat and/or light to form a film.

To the coating solution for forming a charge generation layer and the coating solution for forming a charge transport layer, additives such as a plasticizer, a flowability imparting agent and a pinhole preventing agent may be added, if necessary. The plasticizer may-include paraffin halide, dimethylnaphthalene and dibutylphthalate, the flowability imparting agent may include Modaflow (trade name, produced by Monsant Chemical Co.) and Akulonal 4F (trade name, produced by BASF Co.), and the pinhole preventing agent may include benzoin and dimethylphthalate. These may be suitably selected and used, and the amounts thereof may be suitably determined.

The electrophotographic photoreceptor of the present invention can be obtained by providing, if necessary, a subbing layer by coating a coating solution for a subbing layer on a conductive substrate such as a paper or a plastic film subjected to conductive treatment, a plastic film on which a metal foil such as aluminum is laminated and a metal plate and then drying the coating solution, providing a charge generation layer thereon by coating the coating solution for forming a charge generation layer of the present invention and then drying the coating solution, and then providing a charge transport layer thereon by coating a coating solution for forming a charge transport layer and then drying the coating solution.

The charge generation layer preferably has a thickness of 0.001 to 10 μm, particularly preferably 0.2 to 5 μm. If it is less than 0.001 μm, it is difficult to form the charge generation layer uniformly, while if it exceeds 10 μm, electrophotographic characteristics tend to be lowered. The thickness of the charge transport layer is preferably 5 to 50 μm, particularly preferably 8 to 25 μm. If the thickness is less than 5 μm, initial potential is lowered, while if it exceeds 50 μm, sensitivity tends to be lowered.

As a coating method, there may be employed a spin coating method, a dip coating method, a roll coating method, an applicator coating method and a wire bar coating method.

When the phthalocyanine composition of the present invention is coated by the spin coating method, it is preferred that spin coating is carried out at a rotation number of 200 to 4,000 rpm by using a coating solution for forming a charge generation layer obtained by dissolving or dispersing the phthalocyanine composition (A), the binder resin (B) represented by the formula (I) and the melamine resin or benzoguanamine resin (C) uniformly in the solvent (D) having both a hydroxyl group and an ether group in one molecule. The coating solution for forming a charge generation layer may be coated by a coating method other than the spin coating method, such as a dip coating method, a roll coating method, an applicator coating method and a wire bar coating method, followed by drying, to form a charge generation layer.

The electrophotographic photoreceptor of the present invention may have a protective layer on the surface thereof.

EXAMPLES

The present invention is described in detail by referring to Examples.

Preparation example 1

In 50 ml of sulfuric acid was dissolved 1 g of a phthalocyanine mixture comprising 0.75 g of titanylphthalocyanine and 0.25 g of chloroindium phthalocyanine, and the solution was stirred at room temperature for 30 minutes. Subsequently, the solution was added dropwise to one liter of a deionized water cooled with ice water over about 40 minutes to be precipitated. The mixture was further stirred for 1 hour under cooling and left to stand for one day. After the supernatant was removed by decantation, the precipitates were obtained by centrifugation. These precipitates were washed with a deionized water six times. The pH and conductivity of the washing water after it was washed six times were measured. The pH was measured by using Model pH51 (trade name, manufactured by Yokogawa Denki Co.). Further, the conductivity was measured by Model SC-17A (trade name, manufactured by Shibata Kagaku Kikai Kogyo Co.). The pH of the washing water was 3.3, and the conductivity was 65.1 μS/cm. Subsequently, the precipitates were washed with methanol three times and then dried under vacuum by heating at 60° C. for 4 hours.

Next, 1 g of the resulting product was added to 10 ml of 1,3-dimethyl-2-imidazolidinone, and the mixture was heated and stirred (150° C., one hour). After filtration, the residue was washed with methanol and dried under vacuum by heating at 60° C. for 4 hours to obtain crystal of the phthalocyanine composition of the present invention. The X-ray diffraction spectrum of this crystal is shown in FIG. 1.

Preparation example 2

Crystal of the phthalocyanine composition was obtained according to Preparation example 1 except for using bromoindium phthalocyanine in place of chloroindium phthalocyanine, using toluene in place of 1,3-dimethyl-2-imidazolidinone and carrying out heating and stirring at 110° C. for one hour.

Preparation example 3

Crystal of the phthalocyanine composition was obtained according to Preparation example 1 except for using chlorogallium phthalocyanine in place of chloroindium phthalocyanine, using xylene in place of 1,3-dimethyl-2-imidazolidinone and carrying out heating and stirring at 120° C. for 3 hours.

Preparation example 4

Crystal of the phthalocyanine composition was obtained according to Preparation example 1 except for using chloroaluminum phthalocyanine in place of chloroindium phthalocyanine, using tetralin in place of 1,3-dimethyl-2-imidazolidinone and carrying out heating and stirring at 150° C. for 3 hours.

Preparation example 5

Crystal of the phthalocyanine composition was obtained according to Preparation example 1 except for using bromoindium phthalocyanine in place of chloroindium phthalocyanine, using dioxane in place of 1,3-dimethyl-2-imidazolidinone and carrying out heating and stirring at 110° C. for 8 hours.

Preparation example 6

In 50 ml of sulfuric acid was dissolved 1 g of copper phthalocyanine (produced by Kodak Co.), and the mixture was stirred at room temperature for 30 minutes. Subsequently, the solution was added dropwise to one liter of a deionized water cooled with ice water over about 40 minutes to be precipitated. The mixture was further stirred for one hour under cooling and left to stand for one day. After the supernatant was removed by decantation, the precipitates were obtained by centrifugation. These precipitates were washed with a deionized water six times. The pH and conductivity of the washing water after it was washed six times were measured. The pH was measured by using Model pH51 (trade name, manufactured by Yokogawa Denki Co.). Further, the conductivity was measured by Model SC-17A (trade name, manufactured by Shibata Kagaku Kikai Kogyo Co.). The pH of the washing water was 3.9, and the conductivity was 82.6 μ/cm. Subsequently, the precipitates were washed with methanol three times and then dried under vacuum by heating at 60° C. for 4 hours.

Next, 1 g of the resulting product was added to 10 ml of orthoxylene, and the mixture was heated and stirred (130° C., 3 hours). After filtration, the residue was washed with methanol and dried under vacuum by heating at 60° C. for 4 hours to obtain crystal of β type copper phthalocyanine.

Preparation example 7

Crystal of the phthalocyanine composition was prepared according to Preparation example 1 except for changing the heating time in 1,3-dimethyl-2-imidazolidinone to 12 hours.

Preparation example 8

Crystal of the phthalocyanine composition was obtained according to Preparation example 7 except for using bromoindium phthalocyanine in place of chloroindium phthalocyanine, using toluene in place of 1,3-dimethyl-2-imidazolidinone and carrying out heating and stirring at 110° C. for 12 hours.

Preparation example 9

Crystal of the phthalocyanine composition was obtained according to Preparation example 7 except for using chlorogallium phthalocyanine in place of chloroindium phthalocyanine, using xylene in place of 1,3-dimethyl-2-imidazolidinone and carrying out heating and stirring at 120° C. for 12 hours.

Preparation example 10

Crystal of the phthalocyanine composition was obtained according to Preparation example 7 except for using chloroaluminum phthalocyanine in place of chloroindium phthalocyanine, using tetralin in place of 1,3-dimethyl-2-imidazolidinone and carrying out heating and stirring at 150° C. for 24 hours.

EXAMPLE 1

10 g of the phthalocyanine composition prepared in Preparation example 1 as the phthalocyanine composition (A) which was a charge generation substance, 3.06 g of a polyvinyl acetal resin Ethlec KS-5Z (trade name, produced by Sekisui Kagaku Kogyo Co.)(the compound of the formula (I) wherein R is methylene group, $R^1$ is methyl group, k is 0.03, m is 0.27 and n is 0.70) as the binder resin (B), 13.61 g of a melamine resin ML289 (trade name, produced by Hitachi Chemical Co., Ltd., solid content: 51.0% by weight) as the melamine resin or benzoguanamine resin (C) and 380 g of 2-ethoxyethanol as the solvent (D) having both a hydroxyl group and an ethyl group in one molecule were mixed, and the mixture was dispersed by a ball mill.

Figure 2:
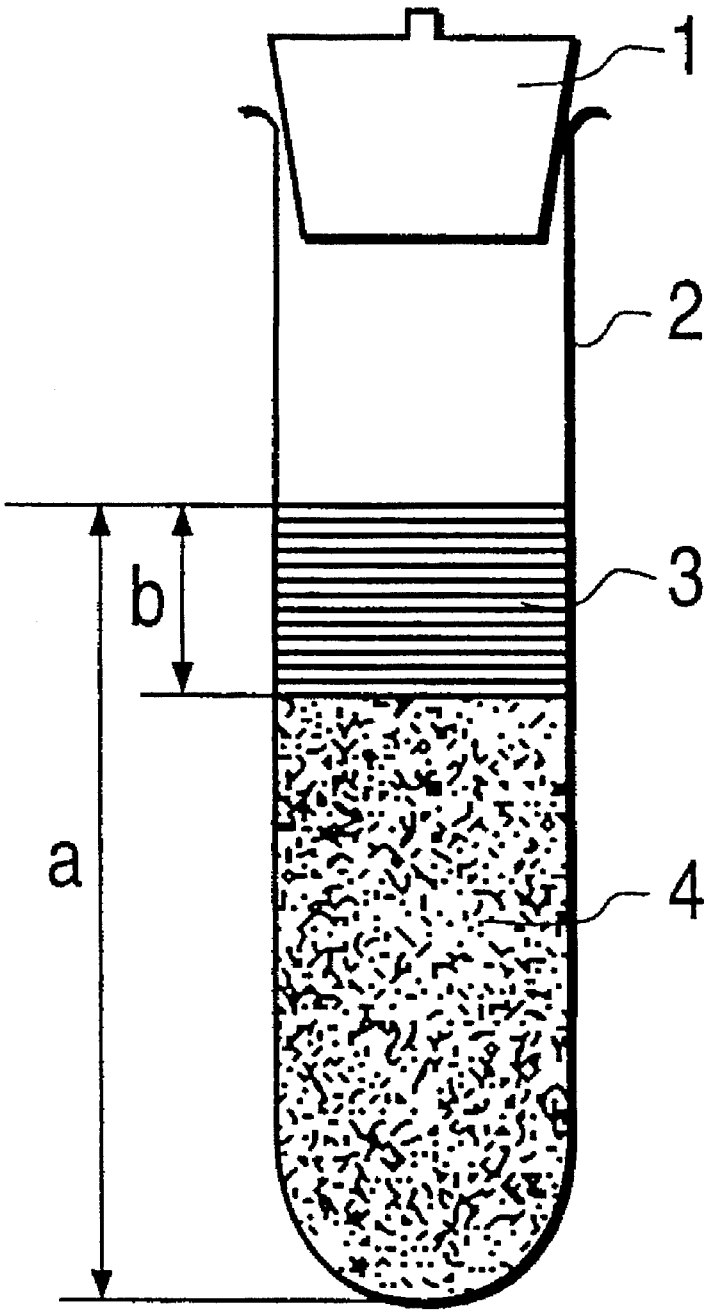
FIG. 2 is a view illustrating an evaluation method of precipitability of a coating solution for forming a charge generation layer of Example 1, wherein the reference numeral 1 is a stopcock, 2 is a test tube, 3 is a supernatant portion and 4 is a precipitation portion.

The coating solution for forming a charge generation layer thus obtained was charged into a test tube with a stopcock, having a inner diameter of 15 mm and a length of 20 cm. The test tube was tightly closed with the stopcock and left to stand at 23° C. for 60 days. When precipitability was measured, it was 2.3% (see FIG. 2). The precipitability was represented by b/a×100 (%) wherein a is a height of the whole coating solution in the test tube and b is a width of the supernatant portion in the test tube.

When water absorption was measured from weight change during drying of the coating solution for forming a charge generation layer and under moisture conditioning with an $NH_4H_2PO_4$-saturated aqueous solution, it was 0.7%. The water absorption was measured by charging the coating solution for forming a charge generation layer into a laboratory dish so as to have a dried thickness of 8 μm, drying the solution at 120° C. for one hour, leaving the laboratory dish to stand at 23° C. for 72 hours in a desiccator in which silica gel was placed, then measuring a weight of $W_1$, leaving the laboratory dish to stand for 72 hours in a vessel (relative humidity: 93%, 23° C.) into which an $NH_4H_2PO4$-saturated aqueous solution was charged and then measuring a weight of $W_2$, and represented by $(W_2-W_1)/W_1\times100$ (%).

The coating solution for forming a charge generation layer obtained was coated on a conductive substrate (an aluminum plate of 100 mm×100 mm×0.1 mm) by the dip coating method and dried at 120° C. for 1 hour to obtain a charge generation layer having a thickness of 0.5 μm.

A coating solution for forming a charge transport layer, obtained by mixing 15 g of the above charge transport substance No. 4, 15 g of a polycarbonate resin Upilon S-3000 (trade name, produced by Mitsubishi Gas Kagaku Co.) and 155 g of methylene chloride was coated on the substrate of the above charge generation layer by the dip coating method, and dried at 120° C. for 1 hour to form a charge transport layer having a thickness of 20 μm, whereby an electrophotographic photoreceptor was obtained.

The electrophotographic characteristics of this electrophotographic photoreceptor were measured by an electrophotographic characteristics-evaluating device Cynthia 30 (trade name, GENTEC Co. at Tokyo, Japan). The photoreceptor was charged by corona discharging of −5 kV under dark condition, and initial charge $V_0$ (−V) after 10 seconds was evaluated. Corona voltage was controlled so that initial charge potential was 700 V, and measured were dark dacay DDR (%) after 5 seconds, sensitivity $E_{1/2}$ (mJ/m$^2$) when exposed to light having a wavelength of 780 nm with a light volume of 20 mW/m$^2$, and residual potential Vr (–V) 1 second after initiation of exposure.

The dark decay was defined according to the following expression:

$$DDR = \frac{\text{Surface potential after 5 seconds}}{\text{Initial surface potential}} \times 100.$$

As a result, $V_0$=850 (–V), DDR=90.2 (%), $E_{1/2}$=4.10 (mJ/m$^2$) and Vr=47 (–V).

Separately, the electrophotographic photoreceptor was pasted to an aluminum drum, and the drum was set in a laser beam printer in which charging, exposure, development, transfer and cleaning were carried out. When image quality was evaluated (charge: –400 V, exposure: 780 nm, 20 mJ/m$^2$, erase: 560 nm), it was A. The standard for evaluating image quality is shown below.

(Evaluation)

A: Image having high quality without defects.

B: A few fogs were observed.

B': A large number of fogs were observed.

C: A few black spots were observed.

C': A large number of black spots were observed.

D: A few white spots were observed.

D': A large number of white spots were observed.

E: Image density was low.

F: Whole printed matter was black or image was not obtained at all (whole printed matter was white).

EXAMPLES 2 TO 15

Electrophotographic photoreceptors were prepared and evaluated according to Example 1 except for using the titanylphthalocyanine compositions obtained in Preparation examples 2 to 5. The results are shown in Table 1 together with the results of Example 1.

TABLE 1

| | Charge generation substance | Charge transport substance | Initial charge $V_0$ (–V) | Dark decay DDR (%) | Sensitivity $E_{1/2}$ (mJ/m$^2$) | Residual potential Vr (–V) | Precipitability (%) | Water absorption (%) | Image quality |
|---|---|---|---|---|---|---|---|---|---|
| Example 1 | Preparation example 1 | No. 1 | 850 | 90.2 | 4.10 | 47 | 2.3 | 0.7 | A |
| Example 2 | Preparation example 2 | No. 1 | 900 | 88.3 | 3.82 | 35 | 2.1 | 0.9 | A |
| Example 3 | Preparation example 3 | No. 1 | 880 | 85.6 | 3.35 | 63 | 1.8 | 1.7 | B |
| Example 4 | Preparation example 4 | No. 1 | 920 | 88.8 | 3.61 | 58 | 3.5 | 1.4 | A |
| Example 5 | Preparation example 5 | No. 1 | 930 | 90.8 | 3.24 | 31 | 2.0 | 0.6 | A |
| Example 6 | Preparation example 1 | No. 4 | 870 | 90.4 | 2.77 | 70 | 3.7 | 1.8 | A |
| Example 7 | Preparation example 2 | No. 4 | 760 | 86.5 | 3.89 | 55 | 2.6 | 0.9 | A |
| Example 8 | Preparation example 3 | No. 4 | 810 | 82.2 | 4.02 | 43 | 4.1 | 0.7 | A |
| Example 9 | Preparation example 4 | No. 4 | 750 | 90.3 | 3.78 | 61 | 4.8 | 1.4 | A |
| Example 10 | Preparation example 5 | No. 4 | 890 | 91.2 | 2.75 | 40 | 1.7 | 0.6 | A |
| Example 11 | Preparation example 1 | No. 3 | 940 | 91.1 | 2.94 | 47 | 4.7 | 1.8 | A |
| Example 12 | Preparation example 2 | No. 3 | 850 | 89.9 | 3.55 | 58 | 4.6 | 0.9 | A |
| Example 13 | Preparation example 3 | No. 3 | 830 | 90.2 | 3.48 | 36 | 2.9 | 1.5 | A |
| Example 14 | Preparation example 4 | No. 3 | 910 | 90.5 | 3.50 | 46 | 2.8 | 1.6 | A |
| Example 15 | Preparation example 5 | No. 3 | 950 | 92.1 | 2.89 | 34 | 1.8 | 0.8 | A |

EXAMPLES 16 TO 27

Electrophotographic photoreceptors were prepared and evaluated according to Example 1 except for using the titanylphthalocyanine compositions obtained in Preparation examples 7 to 10. The results are shown in Table 2.

TABLE 2

| | Charge generation substance | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|
| Example 16 | Preparation example 7 | No. 1 | 390 | 50.2 | 9.8 | 81 | 1.8 | 0.8 | B |
| Example 17 | Preparation example 8 | No. 1 | 360 | 46.2 | 7.9 | 35 | 2.6 | 1.0 | B |
| Example 18 | Preparation example 9 | No. 1 | 240 | 65.0 | 8.4 | 55 | 3.7 | 1.9 | A |
| Example 19 | Preparation example 10 | No. 1 | 330 | 55.2 | 11.5 | 11 | 5.8 | 2.0 | B' |
| Example 20 | Preparation example 7 | No. 4 | 280 | 35.3 | 7.3 | 46 | 2.9 | 1.8 | B |
| Example 21 | Preparation example 8 | No. 4 | 150 | 41.2 | 8.8 | 25 | 2.5 | 1.9 | B |
| Example 22 | Preparation example 9 | No. 4 | 330 | 22.3 | 2.9 | 18 | 1.3 | 1.0 | B |
| Example 23 | Preparation example 10 | No. 4 | 250 | 27.8 | 7.8 | 3 | 3.6 | 1.2 | B |
| Example 24 | Preparation example 7 | No. 3 | 271 | 56.8 | 14.3 | 22 | 3.8 | 1.8 | C |
| Example 25 | Preparation example 8 | No. 3 | 180 | 60.2 | 8.5 | 74 | 6.6 | 0.9 | B |
| Example 26 | Preparation example 9 | No. 3 | 190 | 56.6 | 10.2 | 30 | 5.1 | 1.7 | B |
| Example 27 | Preparation example 10 | No. 3 | 350 | 33.9 | 8.4 | 14 | 1.9 | 1.5 | B |

EXAMPLES 28 TO 34

Electrophotographic photoreceptors were prepared and evaluated according to Examples 1 to 7 except for using a polyvinyl butyral resin Ethlec BMS (trade name, produced by Sekisui Kagaku Kogyo Co.)(the compound of the formula (I) wherein R is an n-butylene group, $R^1$ is a methyl group, k is 0.05, m is 0.25 and n is 0.70) in place of the polyvinyl acetal resin Ethlec KS-5Z (trade name, produced by Sekisui Kagaku Kogyo Co.) as the binder resin (B) and formulating 2.22 g of the polyvinyl butyral resin Ethlec BMS (trade name, produced by Sekisui Kagaku Kogyo Co.) and 15.25 g of the melamine resin ML289 (trade name, produced by Hitachi Chemical Co., Ltd.). The results are shown in Table 3.

EXAMPLES 35 TO 40

Electrophotographic photoreceptors were prepared and evaluated according to Examples 1 to 3 except for using components (C) shown in Table 4 in place of the melamine resin ML289 (trade name, produced by Hitachi Chemical Co., Ltd.) as the component (C) and formulating 3.95 g of the polyvinyl acetal resin Ethlec KS-5Z (trade name, produced by Sekisui Kagaku Kogyo Co.) and 12.1 g of the components (C). The results are shown in Table 4. In Table 4, ML245 is a melamine resin ML245 (trade name, produced by Hitachi Chemical Co., Ltd., solid content: 50.0% by weight) and ML365 is a benzoguanamine resin ML365 (trade name, produced by Hitachi Chemical Co., Ltd., solid content: 50.0% by weight). Further, water absorption was evaluated from weight change during drying with silica gel and under moisture conditioning with an $NH_4H_2PO_4$-saturated aqueous solution, and the results are also shown in Table 4.

TABLE 3

| | Charge generation substance | Charge transport substance | Binder resin (B) | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 28 | Preparation example 1 | No. 1 | Ethlec BMS | 910 | 90.2 | 3.8 | 41 | 1.5 | 2.1 | A |
| Example 29 | Preparation example 2 | No. 1 | | 930 | 86.5 | 2.9 | 55 | 2.6 | 2.8 | B |
| Example 30 | Preparation example 3 | No. 1 | | 1140 | 85.0 | 4.4 | 35 | 2.7 | 2.6 | A |
| Example 31 | Preparation example 4 | No. 1 | | 840 | 94.6 | 3.5 | 48 | 3.8 | 2.7 | A |
| Example 32 | Preparation example 5 | No. 1 | | 1160 | 95.0 | 2.7 | 32 | 1.4 | 1.6 | A |
| Example 33 | Preparation example 1 | No. 4 | | 910 | 85.3 | 2.9 | 50 | 4.0 | 2.9 | A |
| Example 34 | Preparation example 2 | No. 4 | | 880 | 91.4 | 3.8 | 40 | 3.2 | 1.8 | A |

TABLE 4

| | Component (C) | Charge generation substance | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 35 | ML245 | Preparation example 1 | No. 1 | 940 | 86.5 | 3.8 | 61 | 1.5 | 1.3 | A |
| Example 36 | ML365 | Preparation example 1 | No. 1 | 870 | 90.2 | 2.9 | 35 | 2.3 | 0.6 | A |
| Example 37 | ML245 | Preparation example 2 | No. 1 | 940 | 85.0 | 4.4 | 43 | 2.1 | 0.7 | A |
| Example 38 | ML365 | Preparation example 2 | No. 1 | 860 | 94.6 | 3.5 | 27 | 2.2 | 0.3 | A |
| Example 39 | ML245 | Preparation example 3 | No. 1 | 850 | 85.3 | 2.9 | 58 | 2.4 | 0.8 | A |
| Example 40 | ML365 | Preparation example 3 | No. 1 | 950 | 91.4 | 3.8 | 42 | 1.8 | 0.5 | A |

Comparative Examples 1 to 3

Electrophotographic photoreceptors were prepared and evaluated according to Examples 1 to 3 except for using an acryl resin Almatex WP640 (trade name, produced by Mitsui Toatsu Kagaku Co.) in place of the polyvinyl acetal resin Ethlec KS-5Z (trade name, produced by Sekisui Kagaku Kogyo Co.) as the binder resin (B). The results are shown in Table 5.

TABLE 5

| | Charge generation substance | Charge transport substance | Binder resin (B) | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 1 | Preparation example 1 | No. 1 | Almatex WP640 | 440 | 32.3 | 13.8 | 11 | 25.3 | 2.1 | F |
| Comparative example 2 | Preparation example 2 | No. 1 | | 370 | 14.2 | 11.5 | 6 | 42.8 | 1.3 | F |
| Comparative example 3 | Preparation example 3 | No. 1 | | 540 | 34.1 | 7.8 | 75 | 51.1 | 1.8 | C' |

Comparative Examples 4 to 6

Electrophotographic photoreceptors were prepared and evaluated according to Examples 1 to 3 except for using an epoxy resin Epikote 828 (trade name, produced by Yuka Shell Epoxy Co.) in place of the melamine resin ML289 (trade name, produced by Hitachi Chemical Co., Ltd.) as the component (C) and formulating 3.0 g of the polyvinyl acetal resin Ethlec KS-5Z (trade name, produced by Sekisui Kagaku Kogyo Co.) and 7.0 g of the epoxy resin Epikote 828 (trade name, produced by Yuka Shell Epoxy Co.). The results are shown in Table 6.

TABLE 6

| | Epoxy resin | Charge generation substance | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 4 | Epikote 828 | Preparation example 1 | No. 1 | 340 | 46.2 | 1.8 | 8 | 54.4 | 4.7 | F |
| Comparative example 5 | | Preparation example 2 | No. 1 | 470 | 43.3 | 1.9 | 11 | 43.3 | 4.3 | F |
| Comparative example 6 | | Preparation example 3 | No. 1 | 180 | 21.0 | 0.4 | 2 | 48.4 | 5.6 | F |

EXAMPLES 41 TO 46

Electrophotographic photoreceptors were prepared and evaluated according to Examples 1 and 2 except for changing the formulation amounts of the binder resin (B) and the melamine resin or benzoguanamine resin (C) so that the weights (unit: g) of the binder resins (B) and the weights (unit: g, solid content) of the melamine resin or benzoguanamine resin (C) had relations as shown in Table 7. The results are shown in Table 7.

TABLE 7

| | Charge generation substance | Binder resin (B) (g) | Component (C) (g) | Initial charge $V_0$ (–V) | Dark decay DDR (%) | Sensitivity $E_{1/2}$ (mJ/m$^2$) | Residual potential Vr (–V) | Precipitability (%) | Water absorption (%) | Image quality |
|---|---|---|---|---|---|---|---|---|---|---|
| Example 41 | Preparation example 1 | 2.0 | 8.0 | 840 | 85.2 | 3.5 | 51 | 2.9 | 2.2 | A |
| Example 42 | Preparation example 1 | 3.0 | 7.0 | 1070 | 93.5 | 2.7 | 53 | 4.3 | 0.2 | B |
| Example 43 | Preparation example 1 | 4.5 | 5.5 | 770 | 81.0 | 3.6 | 43 | 2.6 | 1.4 | A |
| Example 44 | Preparation example 2 | 2.0 | 8.0 | 960 | 86.2 | 3.5 | 62 | 4.4 | 1.9 | A |
| Example 45 | Preparation example 2 | 3.0 | 7.0 | 1120 | 92.8 | 2.9 | 56 | 5.8 | 0.3 | A |
| Example 46 | Preparation example 2 | 4.5 | 5.5 | 850 | 87.0 | 3.4 | 42 | 3.7 | 1.1 | A |

Comparative Examples 7 to 10

Electrophotographic photoreceptors were prepared and evaluated according to Examples 1 and 2 except for changing the formulation amounts of the binder resins (B) and the components (C) so that the weights (unit: g) of the binder resins (B) and the weights (unit: g, solid content) of the components (C) had relations as shown in Table 8. The results are shown in Table 8.

TABLE 8

| | Charge generation substance | Binder resin (B) (g) | Component (C) (g) | Initial charge $V_0$ (–V) | Dark decay DDR (%) | Sensitivity $E_{1/2}$ (mJ/m$^2$) | Residual potential Vr (–V) | Precipitability (%) | Water absorption (%) | Image quality |
|---|---|---|---|---|---|---|---|---|---|---|
| Comparative example 7 | Preparation example 1 | 1.0 | 9.0 | 680 | 78.2 | 12.5 | 251 | 48.5 | 2.9 | D' |
| Comparative example 8 | Preparation example 1 | 7.0 | 3.0 | 270 | 10.5 | 1.7 | 13 | 31.4 | 4.2 | F |
| Comparative example 9 | Preparation example 2 | 1.0 | 9.0 | 470 | 61.0 | 7.6 | 184 | 37.2 | 3.4 | C' |
| Comparative example 10 | Preparation example 2 | 7.0 | 3.0 | 360 | 46.2 | 1.5 | 3 | 29.9 | 3.9 | F |

EXAMPLES 47 TO 50

Electrophotographic photoreceptors were prepared and evaluated according to Examples 1 to 4 except for using a mixed solvent of 2-ethoxyethanol and ethyl acetate (2-ethoxyethanol:ethyl acetate=6:4 (weight ratio)) in place of 2-ethoxyethanol. The results are shown in Table 9.

TABLE 9

| | Charge generation substance | Mixed solvent | Initial charge $V_0$ (–V) | Dark decay DDR (%) | Sensitivity $E_{1/2}$ (mJ/m$^2$) | Residual potential Vr (–V) | Precipitability (%) | Water absorption (%) | Image quality |
|---|---|---|---|---|---|---|---|---|---|
| Example 47 | Preparation example 1 | 2-Ethoxy ethanol: | 930 | 85.3 | 3.12 | 50 | 12.1 | 2.8 | B |
| Example 48 | Preparation example 2 | ethyl acetate = | 850 | 88.3 | 3.88 | 36 | 10.3 | 2.4 | A |
| Example 49 | Preparation example 3 | 6:4 | 880 | 87.4 | 3.66 | 43 | 14.4 | 1.7 | A |
| Example 50 | Preparation example 4 | | 790 | 90.3 | 3.24 | 38 | 9.8 | 1.8 | B |

EXAMPLES 51 TO 58

Electrophotographic photoreceptors were prepared and evaluated according to Examples 1 and 2 except for using 2-ethoxyethanol and tetrahydrofuran (described as "THF" in Table 10) or methyl ethyl ketone (described as "MEK" in Table 10) which was a solvent having an evaporation rate larger than that of 2-ethoxyethanol, and using mixed solvents formulated at weight ratios shown in Table 10. The results are shown in Table 10.

TABLE 10

| | Charge generation substance | Solvent | 2-Ethoxy-ethanol: solvent | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 51 | Preparation example 1 | THF | 7:3 | 840 | 82.3 | 4.30 | 68 | 15.3 | 1.3 | B |
| Example 52 | Preparation example 1 | THF | 3:7 | 890 | 90.3 | 3.95 | 44 | 8.2 | 2.1 | B |
| Example 53 | Preparation example 1 | MEK | 7:3 | 780 | 84.6 | 4.41 | 81 | 4.8 | 0.8 | A |
| Example 54 | Preparation example 1 | MEK | 3:7 | 820 | 87.5 | 3.53 | 68 | 7.6 | 1.6 | A |
| Example 55 | Preparation example 2 | THF | 7:3 | 780 | 81.6 | 3.58 | 59 | 13.8 | 1.1 | A |
| Example 56 | Preparation example 2 | THF | 3:7 | 820 | 85.5 | 4.22 | 75 | 11.2 | 1.5 | B |
| Example 57 | Preparation example 2 | MEK | 7:3 | 910 | 92.7 | 2.73 | 64 | 9.5 | 0.8 | A |
| Example 58 | Preparation example 2 | MEK | 3:7 | 860 | 88.8 | 3.26 | 68 | 8.5 | 1.9 | A |

EXAMPLE 59

An electrophotographic photoreceptor was prepared and evaluated according to Example 1 except for using 1-methoxy-2-propanol in place of 2-ethoxyethanol as the solvent (D) having both a hydroxyl group and an ether group in one molecule. The results are shown in Table 11.

EXAMPLE 60

An electrophotographic photoreceptor was prepared and evaluated according to Example 1 except for using the β type copper phthalocyanine obtained in Preparation example 6. The results are also shown in Table 11.

EXAMPLE 61

An electrophotographic photoreceptor was prepared and evaluated according to Example 1 except for using ι type nonmetal phthalocyanine (produced by Toyo Ink Co.). The results are shown in Table 11.

EXAMPLE 62

An electrophotographic photoreceptor was prepared and evaluated according to Example 1 except for using chloroaluminum phthalocyanine (produced by Kodak Co.). The results are shown in Table 11.

EXAMPLES 63 TO 65

Electrophotographic photoreceptors were prepared and evaluated according to Example 1 except for using the titanylphthalocyanine compositions obtained in Preparation examples 5, 3 and 4, respectively. The results are shown in Table 11.

TABLE 11

| | Charge generation substance | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|
| Example 59 | Preparation example 1 | No. 1 | 850 | 93.3 | 2.98 | 48 | 0.2 | 0.8 | A |
| Example 60 | Preparation example 6 | No. 1 | 950 | 87.4 | 5.96 | 58 | 6.2 | 1.1 | A |
| Example 61 | ι Type non-metal phthalocyanine | No. 1 | 780 | 88.3 | 4.38 | 39 | 5.4 | 1.4 | A |
| Example 62 | Chloroaluminum phthalocyanine | No. 1 | 720 | 81.2 | 3.97 | 25 | 8.8 | 1.3 | A |
| Example 63 | Preparation example 5 | No. 1 | 940 | 95.5 | 2.73 | 37 | 0.3 | 0.5 | A |
| Example 64 | Preparation example 3 | No. 1 | 850 | 91.4 | 3.15 | 63 | 0.9 | 0.7 | A |
| Example 65 | Preparation example 4 | No. 1 | 910 | 92.2 | 3.02 | 44 | 0.4 | 0.9 | A |

EXAMPLES 66 TO 72

Electrophotographic photoreceptors were prepared and evaluated according to Examples 59 to 65 except for using a polyvinyl butyral resin Ethlec BMS (trade name, produced by Sekisui Kagaku Kogyo Co.) (the compound of the formula (I) wherein R is an n-butylene group, $R^1$ is a methyl group, k is 0.70, m is 0.05 and n is 0.25) in place of the polyvinyl acetal resin Ethlec KS-5Z (trade name, produced by Sekisui Kagaku Kogyo Co.) as the binder resin (B) and formulating 2.22 g of the polyvinyl butyral resin Ethlec BMS (trade name, produced by Sekisui Kagaku Kogyo Co.) and 15.25 g of the melamine resin ML289 (trade name, produced by Hitachi Chemical Co., Ltd.). The results are shown in Table 12.

TABLE 12

| | Charge generation substance | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|
| Example 66 | Preparation example 1 | No. 1 | 920 | 94.3 | 3.21 | 48 | 0.6 | 1.5 | A |
| Example 67 | Preparation example 6 | No. 1 | 960 | 90.4 | 6.03 | 58 | 7.3 | 1.6 | A |
| Example 68 | ι Type non-metal phthalocyanine | No. 1 | 850 | 85.3 | 4.72 | 39 | 5.8 | 2.2 | A |
| Example 69 | Chloroaluminum phthalocyanine | No. 1 | 730 | 80.2 | 3.11 | 25 | 8.2 | 1.8 | A |
| Example 70 | Preparation example 5 | No. 1 | 1120 | 95.6 | 2.65 | 28 | 3.6 | 0.9 | A |
| Example 71 | Preparation example 3 | No. 1 | 1090 | 91.2 | 3.28 | 38 | 1.8 | 1.6 | A |
| Example 72 | Preparation example 4 | No. 1 | 860 | 93.4 | 3.52 | 43 | 2.2 | 1.8 | A |

EXAMPLES 73 TO 96

Electrophotographic photoreceptor were prepared and evaluated according to Examples 59 to 65 except for using cross-linking agents (Component (C)) shown in Table 13 in place of the malamin resin ML289 (trade name, produced by Hitachi Chemical Co., Ltd.) and formulating 3.95 g of the polyvinyl acetal resin Ethlec KS-5Z (trade name, produced by Sekisui Kagaku Kogyo Co.) and 12.1 g of the crosslinking agents. The results are shown in Table 13. In Table 13, ML245 is a melamine resin ML245 (trade name, produced by Hitachi Chemical Co., Ltd., solid content: 50.0% by weight) and ML365 is a benzoguanamine resin ML365 (trade name, produced by Hitachi Chemical Co., Ltd., solid content: 50.0% by weight). Further, water absorption was evaluated from weight change during drying with silica gel and under moisture conditioning with an $NH_4H_2PO_4$-saturated aqueous solution, and the results are also shown in Table 13.

TABLE 13

| | Charge generation substance | Charge transport substance | Crosslinking agent | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 73 | Preparation example 1 | No. 1 | ML245 | 850 | 91.3 | 2.98 | 48 | 0.6 | 1.2 | A |
| Example 74 | Preparation example 1 | No. 1 | ML365 | 920 | 92.5 | 2.61 | 48 | 0.7 | 1.4 | A |
| Example 75 | Preparation example 6 | No. 1 | ML245 | 890 | 87.4 | 5.96 | 58 | 6.2 | 0.8 | A |
| Example 76 | Preparation example 6 | No. 1 | ML365 | 930 | 89.6 | 5.66 | 62 | 5.6 | 1.1 | A |
| Example 77 | ι Type non-metal phthalocyanine | No. 1 | ML245 | 780 | 88.3 | 4.38 | 39 | 5.4 | 0.5 | A |
| Example 78 | ι Type non-metal phthalocyanine | No. 1 | ML365 | 930 | 90.2 | 4.26 | 38 | 3.8 | 0.9 | A |
| Example 79 | Chloroaluminum phthalocyanine | No. 1 | ML245 | 720 | 81.2 | 3.97 | 25 | 8.8 | 1.3 | A |
| Example 80 | Chloroaluminum phthalocyanine | No. 1 | ML365 | 760 | 82.3 | 3.65 | 31 | 7.5 | 1.7 | A |
| Example 81 | Preparation example 5 | No. 1 | ML245 | 840 | 89.5 | 3.34 | 57 | 1.3 | 1.4 | A |
| Example 82 | Preparation example 5 | No. 1 | ML365 | 890 | 90.2 | 3.55 | 55 | 1.2 | 0.8 | A |
| Example 83 | Preparation example 3 | No. 1 | ML245 | 850 | 91.4 | 2.71 | 53 | 0.9 | 1.5 | A |
| Example 84 | Preparation example 3 | No. 1 | ML365 | 900 | 92.2 | 3.18 | 49 | 1.0 | 1.2 | A |
| Example 85 | Preparation example 4 | No. 1 | ML245 | 910 | 92.2 | 3.02 | 64 | 1.1 | 0.7 | A |
| Example 86 | Preparation example 4 | No. 1 | ML365 | 890 | 93.4 | 2.76 | 58 | 0.4 | 1.3 | A |

Comparative Examples 11 to 24

Electrophotographic photoreceptors were prepared and evaluated according to Examples 59 to 65 except for using an acryl resin Almatex WP640 (trade name, produced by Mitsui Toatsu Kagaku Co.) or an acrylic resin Elvacite 2045 (trade name, produced by Du'Pont de Nemours) in place of the polyvinyl acetal resin Ethlec KS-5Z (trade name, produced by Sekisui Kagaku Kogyo Co.) as the binder resin (B). The results are shown in Table 14.

TABLE 14

| | Charge generation substance | Charge transport substance | Binder resin (B) | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 11 | Preparation example 1 | No. 1 | Almatex WP640 | 1030 | 98.2 | 8.92 | 740 | 19.6 | 2.1 | B' |
| Comparative example 12 | Preparation example 6 | No. 1 | | 1120 | 97.1 | 9.33 | 850 | 32.5 | 2.3 | B' |
| Comparative example 13 | ι Type non-metal phthalocyanine | No. 1 | | 1122 | 96.2 | Measurement was impossible | 980 | 56.2 | 3.1 | F |
| Comparative example 14 | Chloroaluminum phthalocyanine | No. 1 | | 1030 | 90.1 | 7.57 | 400 | 66.6 | 2.8 | B' |
| Comparative example 15 | Preparation example 5 | No. 1 | | 1220 | 99.3 | Measurement was impossible | 1160 | 55.4 | 2.9 | F |
| Comparative example 16 | Preparation example 3 | No. 1 | | 1000 | 96.2 | 12.2 | 760 | 62.7 | 3.2 | E |
| Comparative example 17 | Preparation example 4 | No. 1 | | 950 | 97.9 | 11.5 | 530 | 48.8 | 2.8 | D' |
| Comparative example 18 | Preparation example 1 | No. 1 | Elvacite 2045 | 560 | 65.2 | 5.82 | 320 | 50.4 | 2.4 | C' |
| Comparative example 19 | Preparation example 6 | No. 1 | | 825 | 55.0 | 6.23 | 420 | 61.3 | 3.2 | E |
| Comparative example 20 | ι Type non-metal phthalocyanine | No. 1 | | 320 | 36.8 | 0.23 | 240 | 72.5 | 3.7 | F |
| Comparative example 21 | Chloroaluminum phthalocyanine | No. 1 | | 70 | 11.2 | Measurement was impossible | 40 | 50.9 | 4.3 | F |
| Comparative example 22 | Preparation example 5 | No. 1 | | 480 | 60.3 | 4.59 | 330 | 61.3 | 2.6 | E |
| Comparative example 23 | Preparation example 3 | No. 1 | | 520 | 65.5 | 5.12 | 500 | 58.4 | 3.5 | F |
| Comparative example 24 | Preparation example 4 | No. 1 | | 550 | 58.8 | 6.97 | 510 | 65.4 | 2.9 | F |

Comparative Examples 25 to 31

Electrophotographic photoreceptors were prepared and evaluated according to Examples 59 to 65 except for using an epoxy resin Epikote 828 (trade name, produced by Yuka Shell Epoxy Co.) in place of the melamine resin ML289 (trade name, produced by Hitachi Chemical Co., Ltd.) as a cross-linking agent (Component (C)) and formulating 1.0 g of the polyvinyl acetal resin Ethlec KS-5Z (trade name, produced by Sekisui Kagaku Kogyo Co.) and 3.5 g of the-epoxy resin Epikote 828 (trade name, produced by Yuka Shell Epoxy Co.). The results are shown in Table 15. Further, water absorption was evaluated from weight change during drying and under moisture conditioning with an $NH_4H_2PO4$-saturated aqueous solution, and the results are also shown in Table 15.

TABLE 15

| | Charge generation substance | Charge transport substance | Cross-linking agent | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 25 | Preparation example 1 | No. 1 | Epikote 828 | 510 | 55.8 | 2.03 | 20 | 35.5 | 5.6 | C' |
| Comparative example 26 | Preparation example 6 | No. 1 | | 530 | 60.2 | 4.58 | 50 | 38.8 | 5.4 | B' |
| Comparative example 27 | ι Type non-metal phthalocyanine | No. 1 | | 325 | 40.3 | Measurement was impossible | 10 | 56.8 | 5.7 | F |
| Comparative example 28 | Chloroaluminum phthalocyanine | No. 1 | | 50 | 12.2 | Measurement was impossible | 0 | 72.5 | 5.4 | F |
| Comparative example 29 | Preparation example 5 | No. 1 | | 435 | 65.4 | 2.92 | 30 | 45.5 | 5.5 | F |

TABLE 15-continued

| | Charge generation substance | Charge transport substance | Cross-linking agent | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 30 | Preparation example 3 | No. 1 | | 380 | 49.5 | 1.31 | 20 | 36.7 | 5.7 | F |
| Comparative example 31 | Preparation example 4 | No. 1 | | 470 | 54.8 | 0.83 | 10 | 43.3 | 5.6 | B' |

EXAMPLES 87 TO 96

Electrophotographic photoreceptors were prepared and evaluated according to Examples 59 to 65 except for changing the formulation amounts of the binder resin and the cross-linking agent (Component (C)) so that the weight of the binder resin (described as "BP" in Table 16) and the weight of the crosslinking agent (described as "CA" in Table 16, shown in terms of a weight of a solid component) had relations shown in Table 16. The results are shown in Table 16.

TABLE 16

| | Charge generation substance | BP:CA | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 87 | Preparation example 1 | 3.2:6.8 | No. 1 | 850 | 93.3 | 3.18 | 52 | 0.8 | 1.3 | A |
| Example 88 | Preparation example 1 | 1.8:8.2 | No. 1 | 1020 | 89.8 | 2.70 | 47 | 1.7 | 2.1 | A |
| Example 89 | Preparation example 6 | 3.2:6.8 | No. 1 | 950 | 88.4 | 5.96 | 58 | 7.1 | 1.4 | A |
| Example 90 | Preparation example 6 | 1.8:8.2 | No. 1 | 1010 | 91.2 | 6.03 | 63 | 2.3 | 1.9 | A |
| Example 91 | ι Type non-metal phthalocyanine | 3.2:6.8 | No. 1 | 740 | 84.3 | 4.38 | 51 | 4.6 | 1.6 | A |
| Example 92 | ι Type non-metal phthalocyanine | 1.8:8.2 | No. 1 | 820 | 86.2 | 4.56 | 48 | 5.8 | 2.3 | A |
| Example 93 | Chloroaluminum phthalocyanine | 3.2:6.8 | No. 1 | 750 | 80.3 | 3.88 | 28 | 8.7 | 1.8 | A |
| Example 94 | Chloroaluminum phthalocyanine | 1.8:8.2 | No. 1 | 720 | 82.2 | 4.17 | 23 | 9.8 | 1.9 | A |
| Example 95 | Preparation example 5 | 3.2:6.8 | No. 1 | 830 | 87.2 | 3.39 | 43 | 1.4 | 1.4 | A |
| Example 96 | Preparation example 5 | 1.8:8.2 | No. 1 | 940 | 84.5 | 3.64 | 57 | 1.3 | 2.2 | A |

EXAMPLES 97 TO 106

Electrophotographic photoreceptors were prepared and evaluated according to Examples 59 to 65 except for using mixed solvents of 1-methoxy-2-propanol and methyl ethyl ketone (described as "MEK" in Table 17) formulated at weight ratios shown in Table 17 in place of 1-methoxy-2-propanol. The results are shown in Table 17.

TABLE 17

| | Charge generation substance | 1-Methoxy-2-propanol: MEK | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 97 | Preparation example 1 | 70:30 | No. 1 | 880 | 92.4 | 2.91 | 53 | 1.9 | 1.5 | A |
| Example 98 | Preparation example 1 | 30:70 | No. 1 | 910 | 90.2 | 3.15 | 55 | 3.3 | 0.9 | A |

TABLE 17-continued

| | Charge generation substance | 1-Methoxy-2-propanol: MEK | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 99 | Preparation example 6 | 70:30 | No. 1 | 950 | 86.4 | 5.76 | 48 | 8.6 | 1.3 | A |
| Example 100 | Preparation example 6 | 30:70 | No. 1 | 840 | 85.2 | 5.93 | 56 | 12.3 | 1.4 | A |
| Example 101 | ι Type non-metal phthalocyanine | 70:30 | No. 1 | 820 | 82.2 | 4.66 | 63 | 5.5 | 0.8 | A |
| Example 102 | ι Type non-metal phthalocyanine | 30:70 | No. 1 | 830 | 85.2 | 4.21 | 59 | 7.3 | 1.7 | A |
| Example 103 | Chloroaluminum phthalocyanine | 70:30 | No. 1 | 700 | 78.3 | 3.28 | 28 | 8.9 | 1.5 | A |
| Example 104 | Chloroaluminum phthalocyanine | 30:70 | No. 1 | 710 | 75.5 | 3.22 | 26 | 14.6 | 1.8 | A |
| Example 105 | Preparation example 5 | 70:30 | No. 1 | 970 | 87.2 | 3.29 | 35 | 3.4 | 0.6 | A |
| Example 106 | Preparation example 5 | 30:70 | No. 1 | 1020 | 89.5 | 3.54 | 54 | 3.3 | 1.3 | A |

EXAMPLES 107 TO 116

Electrophotographic photoreceptors were prepared and evaluated according to Examples 59 to 65 except for using mixed solvents of 1-methoxy-2-propanol and ethyl acetate (described as "AcOEt" in Table 18) formulated at weight ratios shown in Table 18 in place of 1-methoxy-2-propanol. The results are shown in Table 18.

TABLE 18

| | Charge generation substance | 1-Methoxy-2-propanol: AcOEt | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Example 107 | Preparation example 1 | 70:30 | No. 1 | 920 | 86.5 | 3.00 | 52 | 3.8 | 1.6 | A |
| Example 108 | Preparation example 1 | 30:70 | No. 1 | 810 | 88.4 | 3.22 | 38 | 4.5 | 1.2 | A |
| Example 109 | Preparation example 6 | 70:30 | No. 1 | 940 | 89.4 | 5.86 | 65 | 9.5 | 1.5 | A |
| Example 110 | Preparation example 6 | 30:70 | No. 1 | 1120 | 88.2 | 6.35 | 97 | 13.5 | 1.8 | A |
| Example 111 | ι Type non-metal phthalocyanine | 70:30 | No. 1 | 870 | 85.4 | 4.27 | 63 | 8.4 | 1.0 | A |
| Example 112 | ι Type non-metal phthalocyanine | 30:70 | No. 1 | 820 | 81.0 | 4.48 | 43 | 12.2 | 1.6 | A |
| Example 113 | Chloroaluminum phthalocyanine | 70:30 | No. 1 | 740 | 73.9 | 3.28 | 42 | 10.3 | 1.8 | A |
| Example 114 | Chloroaluminum phthalocyanine | 30:70 | No. 1 | 690 | 69.8 | 3.22 | 32 | 16.8 | 2.3 | A |
| Example 115 | Preparation example 5 | 70:30 | No. 1 | 950 | 85.5 | 3.57 | 52 | 4.3 | 0.8 | A |
| Example 116 | Preparation example 5 | 30:70 | No. 1 | 970 | 86.6 | 3.78 | 75 | 5.6 | 1.5 | A |

Comparative Examples 32 to 41

Electrophotographic photoreceptors were prepared and evaluated according to Examples 59 to 65 except for using methyl ethyl ketone (described as "MEK" in Table 19) or ethyl acetate (described as "AcOEt" in Table 19) in place of 1-methoxy-2-propanol. The results are shown in Table 19.

TABLE 19

| | Charge generation substance | Kind of solvent | Charge transport substance | Initial charge $V_0$ (−V) | Dark decay DDR (%) | Sensitivity $E_{1/2}$ (mJ/m$^2$) | Residual potential Vr (−V) | Precipitability (%) | Water absorption (%) | Image quality |
|---|---|---|---|---|---|---|---|---|---|---|
| Comparative example 32 | Preparation example 1 | MEK | No. 1 | 860 | 62.4 | 6.27 | 92 | 73.4 | 1.9 | B' |
| Comparative example 33 | Preparation example 1 | AcOEt | No. 1 | 720 | 57.7 | 14.27 | 55 | 78.2 | 2.5 | C' |
| Comparative example 34 | Preparation example 6 | MEK | No. 1 | 950 | 73.4 | 6.88 | 103 | 68.6 | 1.7 | B' |
| Comparative example 35 | Preparation example 6 | AcOEt | No. 1 | 420 | 31.3 | Measurement was impossible | 89 | 75.6 | 2.0 | F |
| Comparative example 36 | ι Type non-metal phthalocyanine | MEK | No. 1 | 700 | 68.8 | 7.31 | 230 | 58.5 | 1.6 | C' |
| Comparative example 37 | ι Type non-metal phthalocyanine | AcOEt | No. 1 | 1320 | 96.8 | 12.85 | 450 | 69.3 | 1.8 | B' |
| Comparative example 38 | Chloroaluminum phthalocyanine | MEK | No. 1 | 620 | 55.2 | 1.05 | 18 | 72.3 | 1.9 | F |
| Comparative example 39 | Chloroaluminum phthalocyanine | AcOEt | No. 1 | 430 | 37.2 | Measurement was impossible | 6 | 74.6 | 2.5 | F |
| Comparative example 40 | Preparation example 5 | MEK | No. 1 | 720 | 75.8 | 9.66 | 472 | 68.2 | 1.7 | E |
| Comparative example 41 | Preparation example 5 | AcOEt | No. 1 | 554 | 45.3 | Measurement was impossible | 103 | 75.5 | 2.1 | F |

The coating solution for forming a charge generation layer of the present invention has excellent dispersion stability (e.g. property of being hardly precipitated), coating property and environmental sanitation, and the electrophotographic photoreceptor using this coating solution has excellent electrophotographic characteristics such as charging characteristics, dark decay and sensitivity so that it can be applied suitably to an electrophotographic process in which density and quality higher than those of the prior art are demanded.

We claim:

1. A coating solution for forming a charge generation layer, which comprises:

(A) a phthalocyanine composition containing titanylphthalocyanine, (B) a binder resin represented by the formula:

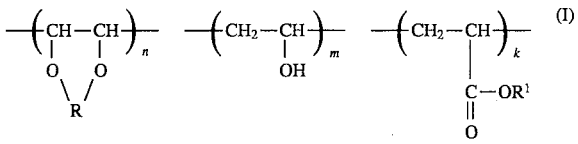

(I)

wherein R represents an alkylene group, $R^1$ represents an alkyl group; and m, n and k each represent a ratio of recurring unit numbers and are numerals satisfying the relations of k+m+n=1, n>m>0 and 0.3≧k≧0, (C) at least one of a melamine resin and a benzoguanamine resin in an amount of 1- to 5-fold in terms of the weight ratio based on the amount of the binder resin, and (D) a solvent having both a hydroxyl group and an ether group in one molecule.

2. The solution according to claim 1, wherein the phthalocyanine composition comprises titanylphthalocyanine and a halogenated metal phthalocyanine in which a central metal is trivalent.

3. The solution according to claim 2, wherein the phthalocyanine composition comprises 20 to 95% by weight of titanylphthalocyanine and the reminder being a halogenated metal phthalocyanine in which a central metal is trivalent.

4. The solution according to claim 3, wherein the phthalocyanine composition comprises 75 to 90% by weight of titanylphthalocyanine and the reminder being a halogenated metal phthalocyanine in which a central metal is trivalent.

5. The solution according to claim 2, wherein the phthalocyanine composition is obtained by making amorphous a phthalocyanine mixture of titanylphthalocyanine and a halogenated metal phthalocyanine in which a central metal is trivalent and then treating the resulting amorphous mixture with an organic solvent.

6. The solution according to claim 2, wherein the trivalent metal is indium.

7. The solution according to claim 1, wherein the phthalocyanine composition (A) has main diffraction peaks at 7.5°, 22.5°, 24.3°, 25.3° and 28.6° of Bragg angles (2θ±0.2°) in an X-ray diffraction spectrum with Cu Kα.

8. The solution according to claim 1, wherein R in the formula (I) is an alkylene group having 1 to 4 carbon atoms and $R^1$ is a methyl group.

9. The solution according to claim 1, wherein the binder resin has a number average molecular weight of 300 to 3000.

10. The solution according to claim 1, wherein the melamine resin or benzoguanamine resin (C) is a resin in which 50% or more of amino groups bonded to a triazine ring is converted into methylol groups and 50% or more of the methylol groups is modified by an alcohol.

11. The solution according to claim 1, wherein the melamine resin or benzoguanamine resin (C) is used in an amount of 1.3 to 3-fold in terms of weight based on the amount of the binder resin (B).

12. The solution according to claim 1, wherein the melamine resin or benzoguanamine resin (C) are used in total in an amount of 1.5 to 2.5-fold in terms of weight based on the amount of the binder resin (B).

13. The solution according to claim 1, wherein the binder resin (B) and the melamine resin or benzoguanamine resin (C) are used in total in an amount of 5 to 500% by weight based on the amount of the phthalocyanine composition (A).

14. A coating solution for forming a charge generation layer, which comprises:

(A) a phthalocyanine composition, (B) a binder resin represented by the formula:

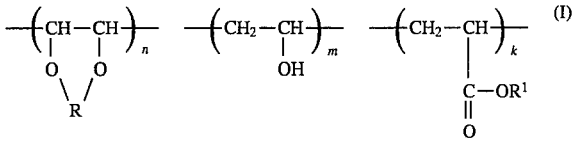

(I)

wherein R represents an alkylene group, $R^1$ represents an alkyl group; and m, n and k each represent a ratio of recurring unit numbers and are numerals satisfying the relations of k+m+n=1, n>m>0 and 0.3≧k≧0, (C) at least one of melamine resin and a benzoguanamine resin in an amount of 1- to 5-fold in terms of the weight ratio based on the amount of the binder resin, and (D) a solvent selected from the group consisting of 2-methoxyethanol, 2-ethoxyethanol, 2-propoxyethanol, 2-butoxyethanol, 1-methoxy-2-propanol and 1-propoxy-2-propanol.

15. The solution according to claim 14, wherein the solvent (D) is 1-methoxy-2-propanol.

16. The solution according to claim 1, wherein the solution further contains a solvent (E) other than the solvent (D).

17. The solution according to claim 16, wherein the solvent (E) has a higher evaporation rate than that of the solvent (D).

18. The solution according to claim 17, wherein both of the solvent (D) and the solvent (E) do not contain a halogen atom.

19. The solution according to claim 16, wherein the solvent (D) is contained in an amount of 20 to 100% by weight based on the total amount of the solvents (D) and (E).

20. An electrophotographic photoreceptor which comprises the coating solution for forming a charge generation layer according to claim 1.

21. The solution according to claim 1, wherein the solvent (D) is selected from the group consisting of 2-methoxyethanol, 2-ethoxyethanol, 2-propoxyethanol, 2-butoxyethanol, 1-methoxy-2-propanol and 1-propoxy-2-propanol.

22. The solution according to claim 21, wherein the solvent (D) is 1-methoxy-2-propanol.

* * * * *